United States Patent [19]

Wolak

[11] 4,099,300

[45] Jul. 11, 1978

[54] TIE PIN

[76] Inventor: Edward A. Wolak, 7708 Normile, Dearborn, Mich. 48126

[21] Appl. No.: 796,836

[22] Filed: May 13, 1977

[51] Int. Cl.[2] ..... A41P 25/04

[52] U.S. Cl. ..... 24/49 CF; 24/49 P

[58] Field of Search ..... 24/49 R, 49 CF, 49 KC, 24/49 K, 49 M, 49 CC, 49 CP, 49 A, 49 TS, 49 C; 2/145

[56] References Cited

U.S. PATENT DOCUMENTS

| | | | |
|---|---|---|---|
| 1,766,695 | 6/1930 | Sorkind | 2/145 |
| 1,784,482 | 12/1930 | Crawford | 24/49 CF |
| 2,002,195 | 5/1935 | Trout | 24/49 CF |
| 2,606,349 | 8/1952 | Albrecht | 24/49 CF |
| 3,116,525 | 1/1964 | Koby | 24/49 KC |
| 3,499,192 | 3/1970 | Holtz | 24/49 P |

*Primary Examiner*—Henry S. Jaudon

*Attorney, Agent, or Firm*—Fisher, Gerhardt & Groh

[57] ABSTRACT

A tie pin for holding the wide front and narrow rear portions of a tie relative to each other and to a shirt by way of a pin attached to the rear folds of the tie and flexible members extending to the shirt front to limit but still permit relative movement of tie portions and shirt and in which the arrangement remains concealed by the tie.

5 Claims, 3 Drawing Figures

TIE PIN

This invention relates to tie pins used to secure a neck tie to the shirt of the wearer and more particularly to such a tie pin which remains concealed during use.

Tie pins often are worn with ties for the purpose of adding decorative aspects and jewelry to the front of a tie. Also tie pins often are used to restrain movement of the tie when the wearer is out of doors in the wind and for safety reasons when the user is near moving machinery which may entangle the tie. Many types of tie pins have been known and used many of which require that the front face of the tie be pierced and after repeated use damage is caused to the tie. Typically the tie jewelry is such that at least a portion is continually exposed to viewers or the arrangement is limited to the possible locations relative to the shirt front as is the case with devices which rely on the buttom holes in shirt fronts as anchor points. Many wearers of ties, however, prefer that the tie be restrained but do not concern themselves with the display of jewelry. Also some of the prior art tie devices maintain the usual forward wide end of a tie and the rearward narrowed end of the tie in fixed relationship relative to each other so that the tie cannot drape naturally and neatly. Also, some prior art tie pins have separable parts, such as tie tacks, part of which may become lost and render the assembly useless.

The present invention has as its principle object a tie clasp overcoming the disadvantages of the prior art tie jewelry. In particular it is an object of the invention to provide tie pin jewelry which remains concealed when in use.

Still another object of the invention is to provide a tie pin which may be used in any selected position longitudinally of the tie or shirt front depending on the preference of the wearer.

Yet another object of the invention is to provide a tie pin in which the front wide portion of the tie and the rear narrow portion of the tie are permitted to move relative to each other and to the shirt front but remain restrained so that only limited movement is permitted which allows the tie portions to drape naturally and yet to be restrained in movemet relative to the front of the user's shirt.

Figure 1:
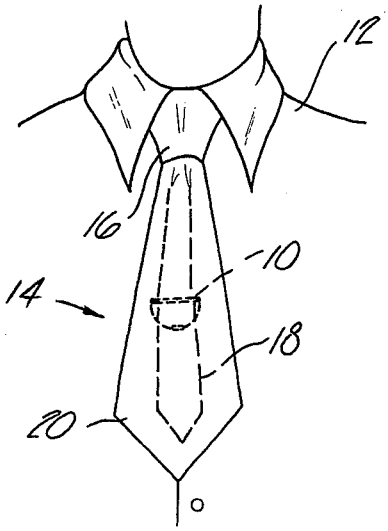
FIG. 1 is a view of a tie with an embodiment of the invention in position illustrating its concealed position behind a tie.
Figure 2:
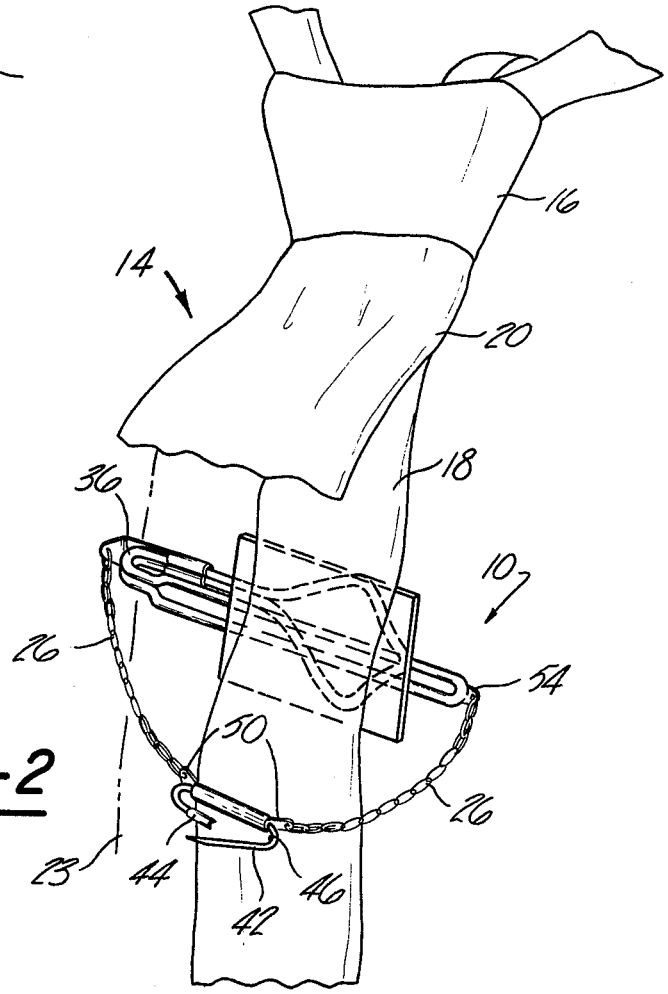
FIG. 2 is a perspective view at an enlarged scale with parts of the tie broken away showing the tie pin in its relative position to a shirt front and to a tie.
Figure 3:
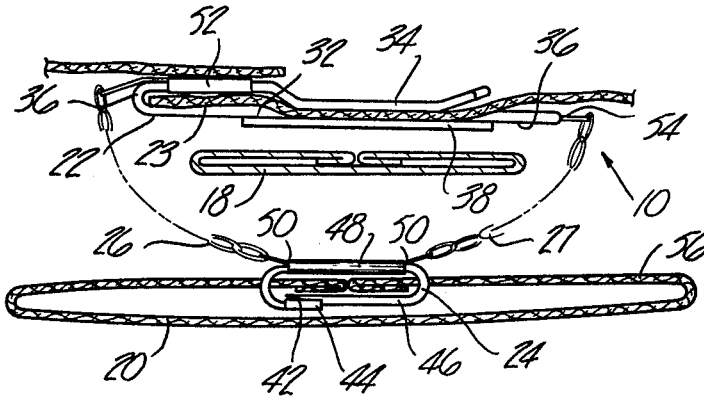
FIG. 3 is a plan sectional view of the tie pin in position relative to a shirt front and to a tie.

Referring to the drawings, a tie pin embodying the invention is designated generally at 10 and is shown in position relative to a shirt 12 and to a cravat or tie 14 in which the principle components include a knot 16 a relatively short and narrow rear portion 18 extending downwardly from the knot 16 and a forward relatively long and wide front portion also extending downwardly from the knot 16.

The tie pin 10 includes a clamp member 22 which is adapted to be attached to the buttoned edge 23 of a shirt front, a pin assembly 24 adapted to be attached to the front tie portion 20 and a pair of flexible elements in the form of linked chains 26 and 27 connected to the pin assembly 24 and also to the clamp 22.

The clamp member 22 preferably has a top bar portion 32 to engage the outer surface of the marginal edge of a buttoned shirt front and a rear bar portion 34 adapted to engage an inner surface of the shirt. The top and rear bars 32 and 34 are interconnected by a U shaped portion 3 which serves to resiliently urge the bar portions toward each other to clamp the edge portion of the shirt front and maintain the clamp member 22 in position. During use the clamp member 22 is intended to remain concealed by the tie portion 20. Nevertheless, the top bar member 32 may serve to mount an identifying tag or ornamental member 38.

The pin assembly 24 preferably has a pointed portion 42 adapted to be seated in a saddle portion 44 and when so seated a closed loop is formed. The pointed portion 42 and saddle portion 44 are formed at opposite ends of a length of resilient wire 46 and a bracket member 48 is clamped around the wire 46. Opposite ends of the bracket member 48 are formed with tabs 50 which are adapted to receive the end links of the chains 26 and 27. The other end of the chain 26 is connected to a mounting 52 clamped on the rear bar 34 adjacent to the U shaped portion 36 and the other end of the chain 27 is connected to a mounting eye 54 formed at the free end of the rear bar member 34.

To use the pin in 10, the tie 14 is tied and arranged so that the rear and front portions drape properly relative to the shirt front 12. The pin assembly 24 is fastened to the rear folds 56 forming the rear surface of the relatively wide and long front tie portion 20. Thereafter the relatively narrow, short rear tie portion may be inserted between the chain 26 and chain 27 and the pin assembly 24 may be clasped to a selected vertical portion of the edge of the shirt front indicated at 23. In this position it will be noted that the tie portions 18 and 20 are permitted some restricted relative movement relative to each other and independently of the shirt front. Similarly it is possible to position the clamp 22 in selected positions vertically of the shirt front so that the tie portions do not remain unduly restrained relative to each other or to the shirt front. This permits the tie to drape naturally and at the same time the pin 10 remains concealed particularly by the front relatively long and wide tie portion 20.

A tie pin has been provided which may be fastened to the rear and at a selected position vertically of the relatively wide long tie front. Another portion of the tie pin is anchored to a selected vertical position of a shirt front and the clamp member and tie pin are connected together by flexible elements which serve to constrain the relatively short and narrow rear tie portion. The arrangement is such that the front and rear tie portions are limited in movement relative to each other and to the shirt front and still are permitted to drape naturally relative to each other without exposing the tie pin which secures the tie portions in position.

The embodiments of the invention in which an exclusive property or privilege is claimed are defined as follows:

1. A tie pin for holding the wide front and the narrow rear portions of a tie relative to a wearer's shirt comprising: a pin element adapted for attachment to selected portions longitudinally and at the rear of the wide front portion of the tie, a clamp member to grip opposed surfaces at the edge of a shirt front and at selected points vertically of the shirt, flexible means extending from opposite ends of said clamp member to said pin element to form a closed loop adapted to receive and confine the short end of said tie to limit lateral displacement thereof relative to said shirt front and said front portion of said tie, said flexible means extending from said clamp member to opposite ends of said pin element.

2. The combination of claim 1 in which said pin element, clamp member and flexible means remain permanently attached to each other.

3. The combination of claim 1 in which said clamp member is wider than said rear tie portion and narrower than said front tie portion to maintain said flexible means in spaced apart relationship to permit relative lateral movement of said front and rear tie portions.

4. The combination of claim 1 wherein the clamp member extends transversely of the shirt edge and is narrower than said front tie portion so that said clamp member remains substantially concealed during the time that it is being worn.

5. A tie pin for holding the wide front and the narrow rear portions of a tie relative to a wearer's shirt comprising: a pin element adapted for attachment to selected portions longitudinally and at the rear of the wide front portion of the tie, a clamp member to grip opposed surfaces at the edge of a shirt front and at selected points vertically of the shirt, flexible means extending from opposite ends of said clamp member to said pin element to form a closed loop adapted to receive and confine the short end of said tie to limit lateral displacement thereof relative to said shirt front and said front portion of said tie, said pin element having a point portion adapted to pierce a rear fold of the tie and a clasp portion to receive the point and retain said pin element in said fold.

* * * * *